US009649677B2

(12) United States Patent
Froböse

(10) Patent No.: US 9,649,677 B2
(45) Date of Patent: May 16, 2017

(54) APPARATUS HAVING A PLURALITY OF COLD ROLLING INSTALLATIONS

(75) Inventor: Thomas Froböse, Versmold (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 1101 days.

(21) Appl. No.: 13/396,868

(22) Filed: Feb. 15, 2012

(65) Prior Publication Data

US 2012/0234072 A1 Sep. 20, 2012

(30) Foreign Application Priority Data

Feb. 16, 2011 (DE) ..... 10 2011 004 203

(51) Int. Cl.
*B21B 21/00* (2006.01)
*B21B 37/78* (2006.01)

(52) U.S. Cl.
CPC ..... *B21B 21/005* (2013.01); *B21B 21/00* (2013.01); *B21B 37/78* (2013.01)

(58) Field of Classification Search
CPC ..... B21B 21/005; B21B 37/78; B21B 21/00; B21B 21/02; B21B 21/04; B21B 21/045; B21B 21/06; B21B 21/065
USPC ..... 72/372, 208, 214, 226, 234
See application file for complete search history.

(56) References Cited

U.S. PATENT DOCUMENTS 2,924,106 A * 2/1960 Zeunert et al. ..... 74/44
4,052,898 A * 10/1977 Miller et al. ..... 72/214
5,096,541 A 3/1992 Arnhold et al.
5,291,108 A * 3/1994 Gerretz et al. ..... 318/433
5,692,736 A 12/1997 Klemm et al.
5,806,357 A * 9/1998 Bouchillon et al. ..... 72/10.2
5,916,320 A * 6/1999 Stinnertz et al. ..... 72/214
6,128,934 A * 10/2000 Houghton ..... 72/10.3
6,763,694 B1 * 7/2004 Boulton et al. ..... 72/245
2004/0173001 A1 * 9/2004 Stinnertz et al. ..... 72/214
(Continued)

FOREIGN PATENT DOCUMENTS

DE GB 1195140 A * 6/1970 ..... B21B 21/005
DE 44 25 739 1/1996
(Continued)

OTHER PUBLICATIONS

German Search Report from DE 10 2011 004 2032 dated Aug. 10, 2011.

*Primary Examiner* — Jimmy T Nguyen
*Assistant Examiner* — Gregory Swiatocha
(74) *Attorney, Agent, or Firm* — Morgan, Lewis & Bockius LLP

(57) ABSTRACT

An apparatus is disclosed having a plurality of cold rolling installations which each have a roll stand movable along a linear path and having at least one roll which is fixed rotatably to the roll stand, a drive connected to the roll stand and having an electric motor so adapted that the roll stand is drivable in an oscillating movement along the linear path, and a feed clamping saddle for feeding a blank. The apparatus has an electric control having at least two control outputs, wherein each control output is connected to the electric motor of the drive of a roll stand and wherein the control is so adapted that in operation of the apparatus it so controls the electric motors that they drive at least two of the roll stands with an adjustable phase displacement between the oscillating movements of the roll stands.

21 Claims, 3 Drawing Sheets

(56) References Cited

U.S. PATENT DOCUMENTS

Figure 1:
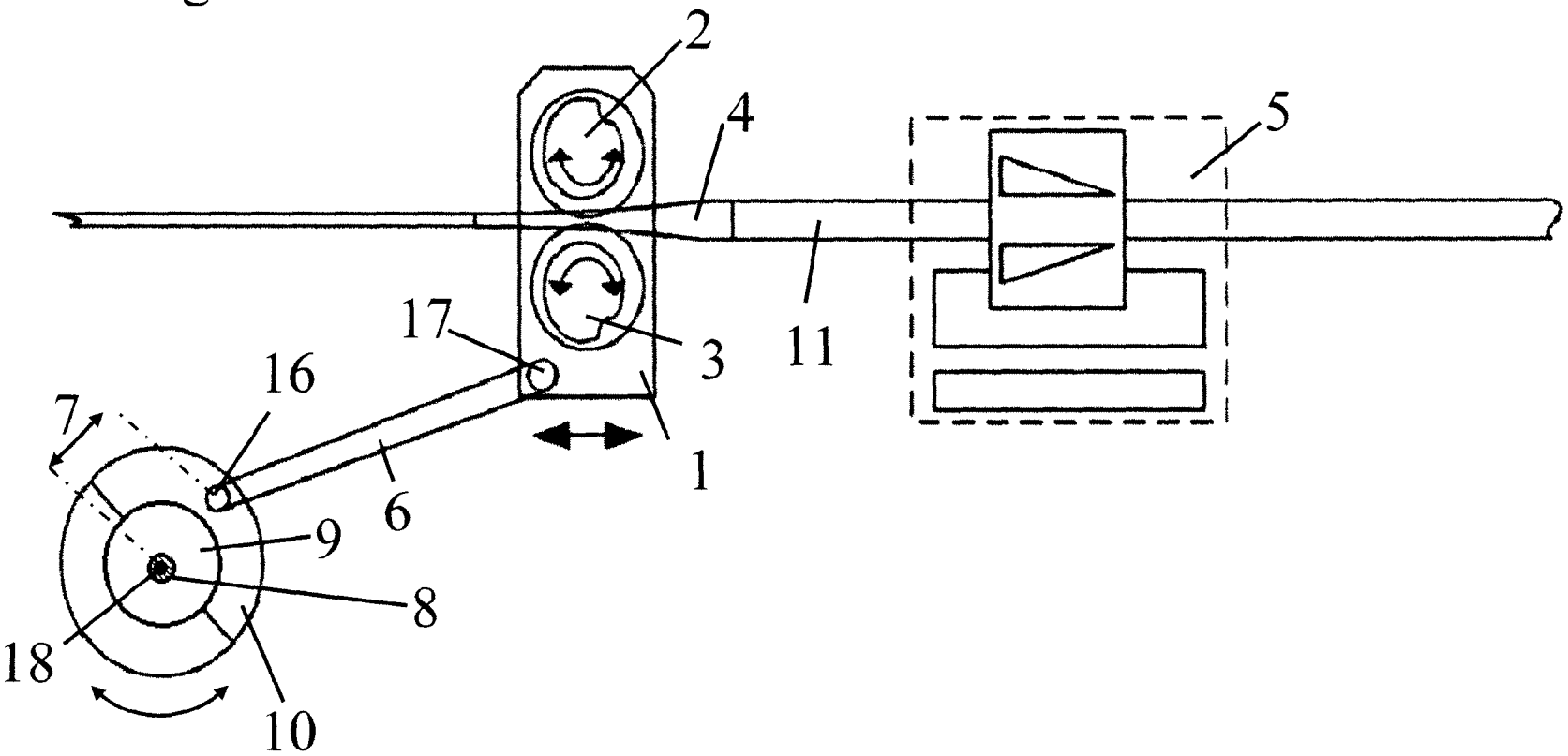

| | | | | |
|---|---|---|---|---|
| 2011/0062205 | A1 | 3/2011 | Schnabel et al. | |
| 2012/0216588 | A1* | 8/2012 | Klingen et al. | 72/234 |

FOREIGN PATENT DOCUMENTS

| | | |
|---|---|---|
| DE | 101 47 046 | 4/2003 |
| DE | 10 2008 021 445 | 11/2009 |
| EP | 0 365 800 | 5/1990 |

* cited by examiner

APPARATUS HAVING A PLURALITY OF COLD ROLLING INSTALLATIONS

RELATED APPLICATION DATA

This application claims priority under 35 U.S.C. §119 and/or §365 to German Application No. 10 2011 004 203.2 (filed 16 Feb. 2011) which is hereby incorporated by reference in its entirety.

The present invention concerns an apparatus having a plurality of cold rolling installations which each have a roll stand movable along a linear path and having at least one roll which is fixed rotatably to the roll stand, a drive connected to the roll stand and having an electric motor so adapted that the roll stand is drivable in an oscillating movement along the linear path, and a feed clamping saddle for feeding a blank.

The invention further concerns a method of controlling an apparatus having a plurality of cold rolling installations which each have a roll stand movable along a linear path and having at least one roll which is fixed rotatably to the roll stand, a drive connected to the roll stand and having an electric motor so adapted that the roll stand is drivable in an oscillating movement along the linear path, and a feed clamping saddle for feeding a blank.

For the manufacture of precise metal tubes, in particular of steel, an expanded hollow-cylindrical blank is reduced by pressure stresses. In that case the blank is converted to the form of a tube of defined reduced outside diameter and defined wall thickness.

The most wide-spread reducing method for tubes is known as cold pilgering, the blank being referred to as the tube shell. In the rolling operation the tube shell is pushed in the completely cold condition over a rolling mandrel which is calibrated, that is to say which is of the inside diameter of the finished tube, and in that situation is embraced from the outside by two rolls which are calibrated, that is to say which define the outside diameter of the finished tube, and are rolled out in the longitudinal direction over the rolling mandrel.

During cold pilgering the tube shell experiences a stepwise feed in a direction towards the rolling mandrel or beyond same while the rolls are horizontally reciprocated rotatingly over the mandrel and thus the tube shell. In that case the horizontal movement of the rolls is predetermined by a roll stand to which the rolls are rotatably mounted. The rolls receive their rotary movement from a rack which is stationary relative to the roll stand and into which engage gears which are fixedly connected to the roll shafts. The feed of the tube shell over the mandrel is effected by means of a feed clamping saddle which permits a translatory movement in a direction parallel to the axis of the rolling mandrel. The linear feed of the feed clamping saddle in the known cold pilger rolling installations is achieved by means of a ball screw drive or a linear motor.

The conically calibrated rolls arranged in mutually superposed relationship in the roll stand rotate in opposite relationship to the feed direction of the feed clamping saddle. The so-called pilger mouth formed by the rolls engages the tube shell and the rolls push a small wave of material away from the outside, the wave being stretched out by the smoothing caliber of the rolls and the rolling mandrel to afford the intended wall thickness until the clearance caliber of the rolls releases the finished tube. During the rolling operation the roll stand with the rolls mounted thereto moves in opposite relationship to the feed direction of the tube shell. After reaching the clearance caliber of the rolls the tube shell is fed by means of the feed clamping saddle by a further step towards the rolling mandrel while the rolls with the roll stand move back into their horizontal starting position. At the same time the tube shell experiences a rotation about its axis to achieve a uniform shape for the finished tube. Rolling over each tube portion a plurality of times provides a uniform wall thickness and roundness for the tube and uniform inside and outside diameters.

While as described above the linear feed of the feed clamping saddle in cold pilger rolling installations is implemented by means of a ball screw drive or alternatively also a linear drive the horizontal reciprocating movement of the roll stand is achieved by means of a crank drive. In that case the crank drive conventionally comprises a transmission, a flywheel, a connecting rod and suitable lubrication, the crank drive being driven by an electric motor. The electric motor is connected to the transmission by way of a coupling and to the flywheel by way of a further coupling. At a first end the connecting rod is connected to the flywheel by means of a bearing. In that case the bearing is arranged eccentrically relative to the axis of rotation of the flywheel. The second end of the connecting rod is also connected to the roll stand by means of a bearing so that the rotary movement of the flywheel is converted into a translatory movement of the roll stand. In that case the direction of translatory movement of the roll stand is predetermined by guide rails and is substantially parallel to the feed direction of the tube shell.

A typical roll stand for a cold pilger rolling installation is of a mass of about 150 tonnes which must be reciprocated during operation of the cold pilger rolling installation. Due to the periodically repeated accelerations and decelerations of the mass of the roll stand the installation in operation transmits high forces in the form of vibrations to its base plate and through same further to the building in which the cold pilger rolling installation is disposed. That applies to an increased degree when a plurality of cold pilger rolling installations are operated simultaneously in a single building, in particular a factory workshop, as is a common practice in modern production operations. In that respect in the worst-case scenario the forces of the individual cold pilger rolling installations, that are transmitted to the building, and the transmitted vibrations, can lead to damage to the building itself or other machines arranged in the factory workshop.

In comparison with that state of the art the object of the present invention is to provide an apparatus having a plurality of cold rolling installations which are so adapted that the forces transmitted from the rolling installations to the building or parts thereof are minimised and a method of controlling such an apparatus.

In accordance with the invention to attain that object there is proposed an apparatus having a plurality of cold rolling installations which each have a roll stand movable along a linear path and having at least one roll which is fixed rotatably to the roll stand, a drive connected to the roll stand and having an electric motor so adapted that the roll stand is drivable in an oscillating movement along the linear path, and a feed clamping saddle for feeding a blank, wherein the apparatus has an electric control having at least two control outputs, wherein each control output is connected to the electric motor of the drive of a roll stand and wherein the control is so adapted that in operation of the apparatus it so controls the electric motors that they drive at least two of the roll stands with an adjustable phase displacement between the oscillating movements of the roll stands.

Adjustment of the phase displacement between the roll stands of two cold rolling installations makes it possible to reduce the moments and forces transmitted from the installations to the base plate or the building enclosing the rolling installations.

In an embodiment of the invention the pilger rolling installation is a cold pilger rolling installation.

When in accordance with the present invention reference is made to a phase displacement between the oscillating movements of two roll stands of the arrangement according to the invention it is assumed that they perform the translatory movements at the same frequency. Without phase displacement the roll stands then move in synchronised relationship. In other words they simultaneously reach both their front and also their rear reversal points. A phase displacement of 180° means that, when one of the roll stands reaches its front reversal point, the other at the same time just reaches its rear reversal point, and vice-versa.

It is to be assumed that the moments or forces transmitted by two electric motors of two cold rolling installations to the building or parts thereof are at a maximum when the two roll stands move in phase at the same frequency.

To reduce the moments or forces transmitted to the building or parts thereof, in an embodiment with precisely two cold rolling installations, it is desirable if the control is so adapted that in operation of the arrangement it so controls the electric motors that the oscillating movements of the two roll stands of the cold rolling installations have a phase displacement relative to each other in a range of between 75° and 105°, but preferably 90°. In an alternative embodiment also with precisely two cold rolling installations the preferred phase displacement between the oscillating movements of the two roll stands is in a range of between 165° and 195° but preferably is 180°.

In an embodiment of the invention the electric motor of the drive of the roll stand is an electromechanical linear motor.

In an alternative embodiment the drive of the roll stand has a flywheel on a drive shaft which is mounted rotatably about an axis of rotation and a connecting rod having a first or second end, wherein the first end of the connecting rod is fixed to the flywheel at a radial spacing from the axis of rotation and wherein the second end of the connecting rod is fixed to the roll stand so that in operation of the installation a rotary movement of the flywheel is converted into a translatory movement of the roll stand. In that arrangement the electric motor has a motor shaft, the motor shaft of the drive motor and the drive shaft being coupled together such that a rotary movement of the motor shaft leads to a rotary movement of the drive shaft and thus the drive motor drives the flywheel.

In an embodiment the electric motor is a torque motor. Such a torque motor has the advantage that it can directly drive the flywheel and the transmission which in the state of the art is provided between the electric motor and the flywheel is rendered redundant. Frictional losses and wear phenomena are reduced in that way. In addition the number of mechanical components is also markedly reduced, which inter alia reduces the costs incurred by the storage of spare parts. The installation stoppage time caused by possible repairs is limited. A torque motor provides a high torque at a low rotary speed and involves a compact structural volume. The torque motor used here can be both in the form of a synchronous and also an asynchronous motor. For the present invention such torque motors have the additional advantage that they can be very accurately actuated so that a phase displacement between the movements of the roll stands can be precisely adjusted. In particular any coupling or transmission play is eliminated when using such a direct drive.

In an embodiment the motor shaft and the drive shaft are so connected together that a full revolution of the motor shaft causes a full revolution of the drive shaft. Such a coupling configuration can be implemented for example by way of a coupling between the motor shaft and the drive shaft of the flywheel.

In an embodiment the motor shaft and the shaft forming the axis of rotation of the flywheel are in one piece.

In an embodiment the control has a first signal input for a first measuring signal and a second signal input for a second measuring signal, wherein the control is so adapted that in operation of the apparatus it adjusts the phase displacement between the oscillating movement of a first roll stand and the oscillating movement of a second roll stand in dependence on the first measuring signal and the second measuring signal.

In an embodiment in operation of the apparatus the first signal input receives a first measuring signal which is a measurement of the instantaneous phase position of the oscillating movement of the first roll stand and the second signal input receives a second measuring signal which is a measurement for the instantaneous phase position of the oscillating movement of the second roll stand, wherein the control is so adapted that in operation of the apparatus it determines from the first measuring signal and the second measuring signal an actual value of the phase displacement between the first and second roll stands, compares the actual value of the phase displacement to a predetermined reference value of the phase displacement and so controls the first electric motor and the second electric motor that the deviation between the actual value of the phase displacement and the reference value of the phase displacement does not exceed a predetermined threshold.

The control is now so adapted that it calculates the phase difference between the roll stands of two cold rolling installations from the detected torques and compares that instantaneous phase position as the actual value to a predetermined reference value of the phase difference. If the actual value and the reference value differ from each other more than a predetermined value the control changes the phase displacement between the two roll stands being considered.

In such an embodiment for example the instantaneous torque of two electric motors of the roll stands of two cold rolling installations is detected. The position of the roll stand along its path in the oscillating translatory movement and thus the position of the oscillation movement can be determined from the torque of the drive motor for the roll stand of a cold rolling installation.

The speed of the roll stand follows approximately a sinusoidal configuration along the linear path of displacement in the oscillatory movement of the roll stand if the instantaneous speed of the roll stand is plotted in relation to time. At the reversal points, that is to say at the front and rear ends of the linear displacement travel, the speed is zero and it reaches a maximum approximately at the middle of the path of the translatory movement of the roll stand. The torque transmitted in the idle mode by the moved mass of the roll stand to the electric motor by way of the connecting rod is of a correspondingly sinusoidal configuration. That is received by the mounting arrangement for the motor on the building or a part and is transmitted to the building. At the reversal points of the roll stand along its translatory movement that torque transmitted to the motor and thus the torque of the motor is at a maximum while it reaches a minimum between the reversal points.

In that respect it is desirable if the control is so adapted that it minimises the overall moment transmitted from the two roll stands being considered to the building or a part thereof. Such minimisation is achieved in particular when the two roll stands involve a phase displacement of 90° relative to each other. With a phase displacement of 0° the forces transmitted to the building or a part thereof are particularly great in one direction while with a phase displacement of 180° between the movements of two roll stands particularly high shearing forces occur at least in a part of the building.

In an embodiment therefore the first signal input is connected to the first electric motor and in operation of the apparatus the first signal input receives a first measuring signal which is a measurement of the instantaneous torque of the first electric motor, the second signal input is connected to the second electric motor and in operation of the apparatus the second signal input receives a second measuring signal which is a measurement of the instantaneous torque of the second electric motor.

Such an embodiment has the advantage that it can manage without an additional sensor for detecting the phase position of the roll stands.

In an alternative embodiment the first signal input is connected to a sensor for detecting the phase position of the first roll stand and the second signal input is connected to a sensor for detecting the phase position of the second roll stand.

Examples of such sensors are for example a torque sensor which detects the torque of the electric motor.

In an alternative embodiment the sensor can be an optical sensor which detects the position of the roll stand. It is also possible to detect the phase position of the oscillating movement of a roll stand with a vibration sensor fixed to the cold rolling installation, in particular to the roll stand.

In a further embodiment at least one of the sensors is a sensor which detects the bearing forces of the electric motor.

All those sensors are suitable for determining the currently prevailing phase position of the one roll stand so that the actual value of the phase difference between the roll stands of the cold rolling installations are determined from two measurement values for two different rolling installations and can be compared to a predetermined reference value in respect of the phase displacement.

In a further embodiment alternatively or additionally to detection of the actual value of the phase position of at least two roll stands the vibrations transmitted to the building accommodating the rolling installations, or parts of the building, is detected and the phase displacement between the oscillating movements of two roll stands is so adjusted that the transmitted vibrations are minimal.

For that purpose in an embodiment the control has a signal input for a measuring signal, wherein the signal input is connected to a vibration sensor for detecting the vibrations transmitted by the plurality of cold rolling installations to a building enclosing same or a part thereof and wherein the control is so adapted that in operation of the apparatus it so controls the electric motors of the cold rolling installations that the vibrations transmitted to the building are minimal.

The above-indicated object is also attained by a method of controlling an apparatus having a plurality of cold rolling installations which each have a roll stand movable along a linear path and having at least one roll which is fixed rotatably to the roll stand, a drive connected to the roll stand and having an electric motor so adapted that it drives the roll stand in an oscillating movement along the linear path, and a feed clamping saddle for feeding a blank, wherein the method comprises the steps: controlling the electric motor of a drive for a first roll stand and controlling the electric motor of a drive for a second roll stand so that in operation of the apparatus the oscillating movement of the first roll stand and the oscillating movement of the second roll stand have a selectable and adjustable phase displacement.

In a first embodiment, for adjustment of the phase displacement between the oscillating movements of the first and second roll stands, the instantaneous phase positions of the oscillating movements of the first roll stand and the second roll stand are detected and an actual value for the phase displacement between the oscillating movements of the first and second roll stands is determined therefrom. Subsequently that actual value is compared to a predetermined reference value and the instantaneous phase position is altered by actuation of the motors if the deviation between the actual value and the reference value of the phase displacement exceeds a predetermined threshold.

For that purpose in an embodiment the method according to the invention additionally includes the steps: detecting a first measuring signal, detecting a second measuring signal, and adjusting the phase displacement of the oscillating movements of the first and second roll stands in dependence on the first and second measuring signals.

In addition in an embodiment the first measuring signal is a measurement of the instantaneous phase position of the oscillating movement of the first roll stand and the second measuring signal is a measurement of the instantaneous phase position of the oscillating movement of the second roll stand, wherein the method additionally comprises the steps: determining an actual value of the phase displacement between the oscillating movements of the first and second roll stands from the first measuring signal and the second measuring signal, comparing the actual value of the phase displacement to a predetermined reference value of the phase displacement, and controlling the first and second electric motors so that a deviation between the actual value and the reference value of the phase displacement does not exceed a predetermined threshold.

In that respect in an embodiment the first measuring signal is a measurement of the instantaneous torque of the first electric motor and the second measuring signal is a measurement of the instantaneous torque of the second electric motor.

In an alternative embodiment the instantaneous phase position of the oscillating movement of each cold rolling installation is not detected, but the vibrations transmitted overall from the plurality of cold rolling installations to the building enclosing same or a part thereof are detected and they are minimised by adjustment of the phase difference between the oscillating movements of the roll stands of the individual cold rolling installations.

Further advantages, features and possible uses of the present invention will be apparent from the description hereinafter of embodiments and the related Figures.

Figure 2:
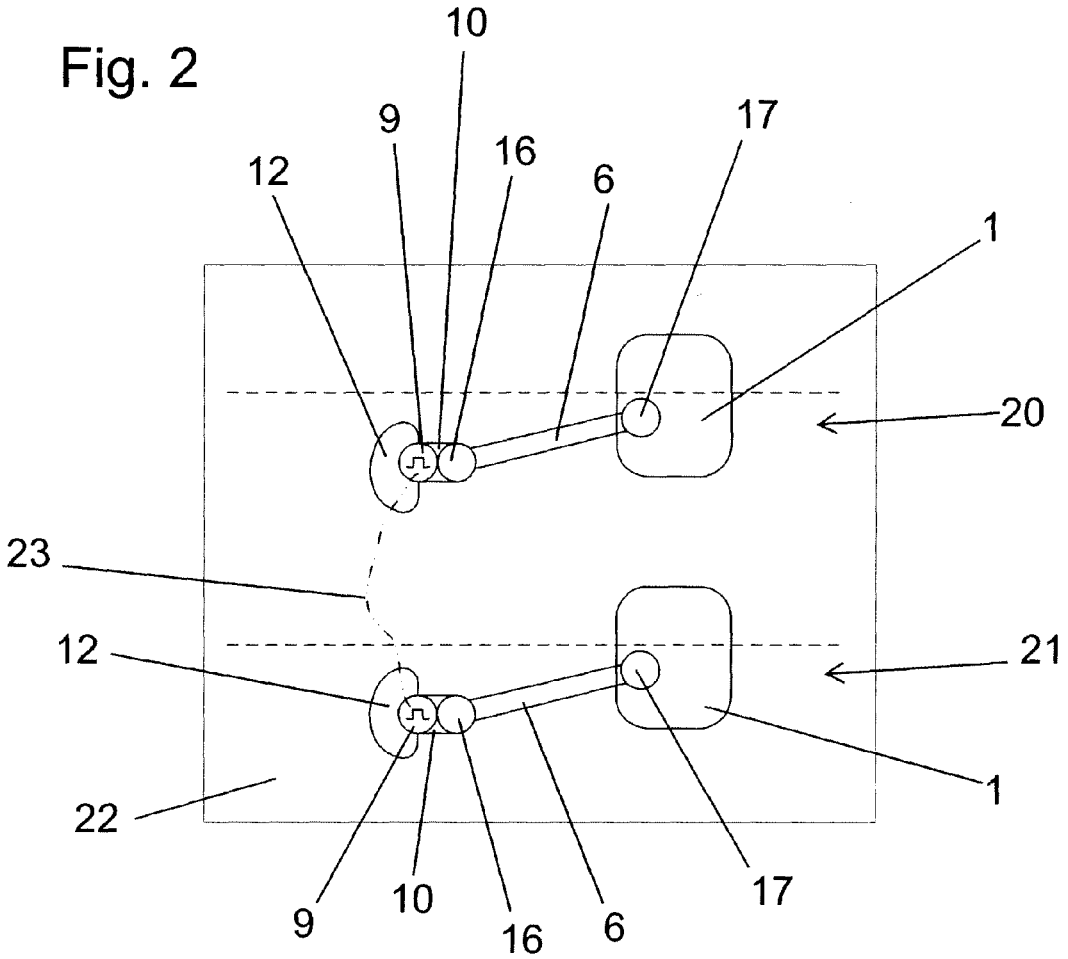
Figure 3:
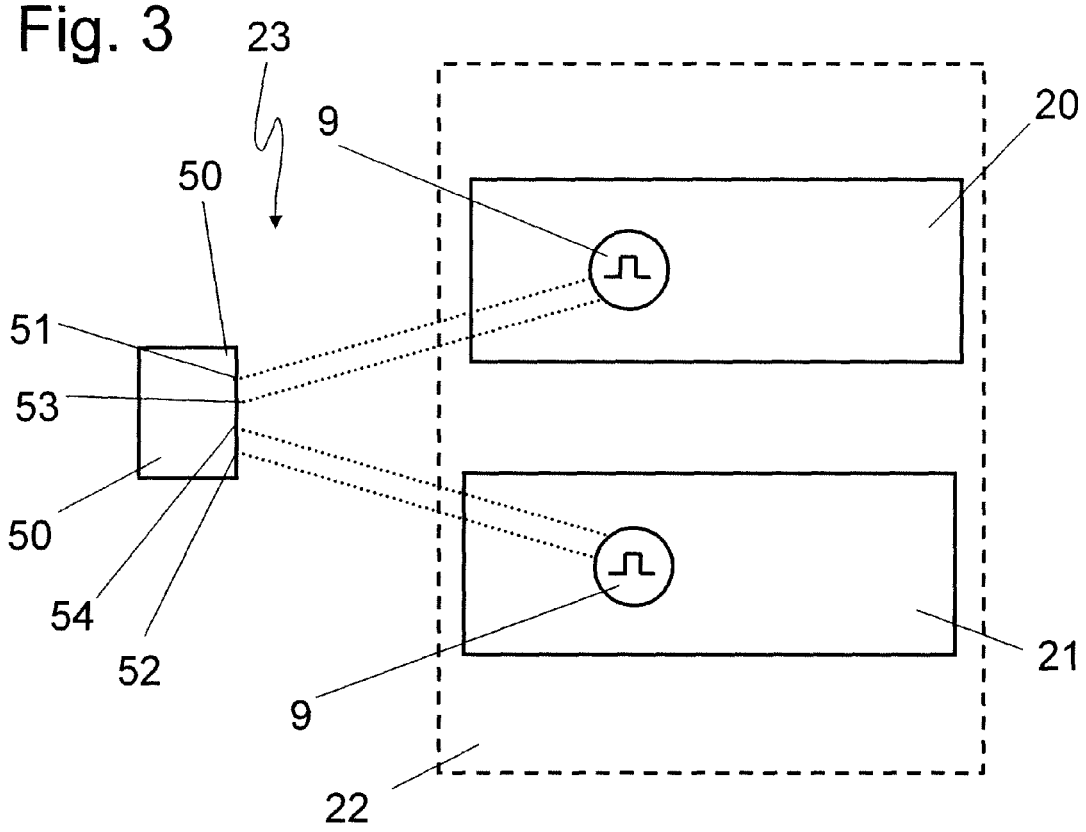
Figure 4:
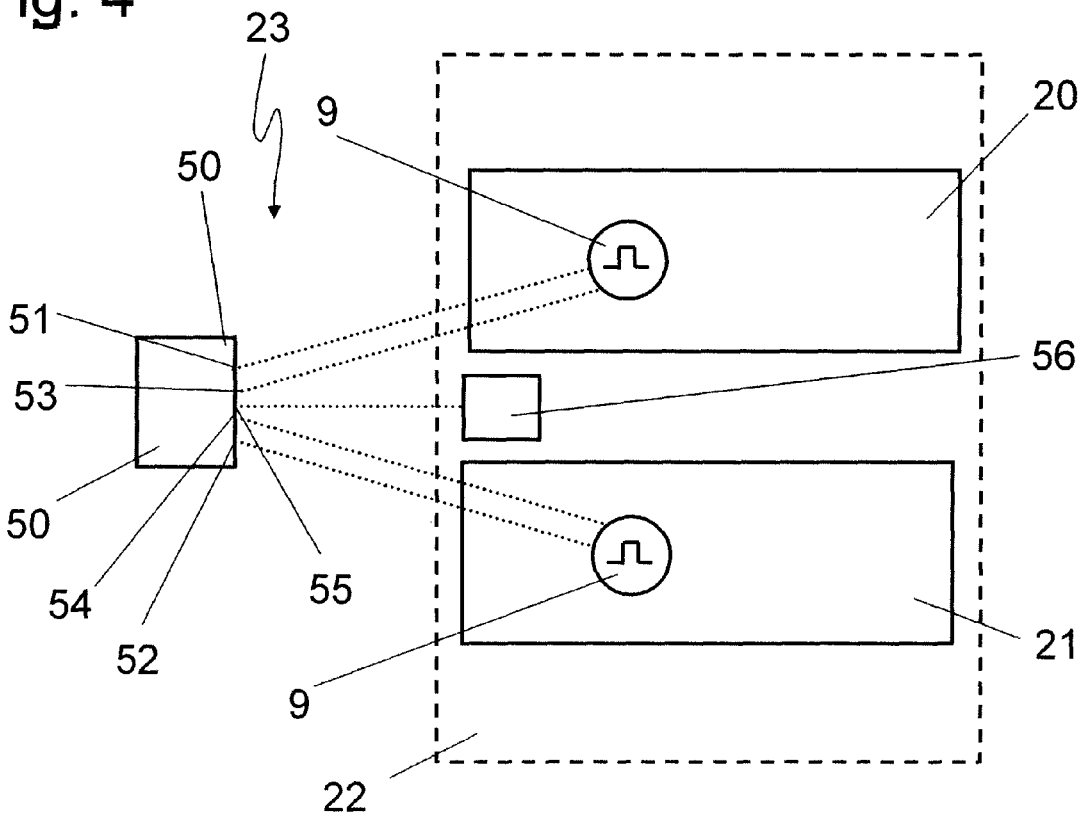

FIG. 1 shows a diagrammatic side view illustrating the structure of a cold pilger rolling installation according to the state of the art, FIG. 2 shows a diagrammatic view of a first embodiment of the apparatus according to the invention with a plurality of cold pilger rolling installations, FIG. 3 shows a first embodiment of the electronic shaft 23 of FIG. 2, and FIG. 4 shows an alternative embodiment of the electronic shaft 23 of FIG. 2.

FIG. 1 is a diagrammatic side view showing the structure of a cold pilger rolling installation as is provided in a large number in the arrangement according to the invention.

The rolling installation comprises a roll stand 1 having rolls 2, 3, a calibrated rolling mandrel 4 and a drive for the roll stand 1. The drive for the roll stand 1 has a connecting rod 6, a drive motor 9 and a flywheel 10. A first end 16 of the connecting rod 6 is connected to the flywheel 10 eccentrically relative to the axis of rotation 18 of the drive shaft 8. In the illustrated embodiment the axis of rotation of the motor shaft coincides with the axis of rotation 18 of the drive shaft 8 of the flywheel 10.

When the rotor of the drive motor rotates a torque is produced, which is transmitted to the motor shaft connected to the rotor. The motor shaft is connected to the flywheel 10 of the drive train in such a way that the torque is transmitted to the flywheel 10. As a consequence of the torque the flywheel 10 rotates about its axis of rotation. The first end 16 of the connecting rod 6, that is fixed to the flywheel 10 by means of a bearing at a radial spacing 7 from the axis of rotation 18 experiences a tangential force and transmits it by way of the connecting rod to the second end 17 thereof. That is connected to the roll stand 1 so that the roll stand is moved with an oscillating movement along the direction of travel predetermined by the guide rail of the roll stand.

During the cold pilger rolling operation on the rolling installation shown in FIG. 1 the tube shell 11 experiences a stepwise feed in a direction towards and beyond the rolling mandrel 4 while the rolls 2, 3 are horizontally reciprocated rotatingly over the mandrel 4 and thus over the tube shell 11. In that case the horizontal movement of the rolls 2, 3 of the roll stand 1 is predetermined by the rolls 2, 3 being rotatably mounted. The roll stand 1 is reciprocated in a direction parallel to the rolling mandrel 4 while the rolls 2, 3 themselves receive their rotary movement by virtue of a rack which is stationary relative to the roll stand 1 and into which engage gears fixedly connected to the roll shafts. The feed for the tube shell 11 over the mandrel 4 is effected by means of the feed clamping saddle 5 which permits a translatory movement in a direction parallel to the axis of the rolling mandrel. The conically calibrated rolls 2, 3 arranged one above the other in the roll stand 1 rotate in opposite relationship to the feed direction of the feed clamping saddle 5. The so-called pilger mouth formed by the rolls engages the tube shell 11 and the rolls 2, 3 press a small wave of material away from the outside, the wave being stretched out by a smoothing caliber of the rolls 2, 3 and the rolling mandrel 4 to give the intended wall thickness until a clearance caliber of the rolls 2, 3 releases the finished tube. During the rolling procedure the roll stand 1 with the rolls 2, 3 mounted thereto moves in opposite relationship to the feed direction of the tube shell 11. After reaching the clearance caliber of the rolls 2, 3, the tube shell 11 is advanced by means of the feed clamping saddle 5 by a further step towards the rolling mandrel 4 while the rolls 2, 3 return with the roll stand 1 to their horizontal starting position. At the same time the tube shell 11 experiences a rotation about its axis to achieve a uniform shape for the finished tube. A uniform wall thickness and roundness for the tube and uniform inside and outside diameters are achieved by rolling over each tube portion a plurality of times.

During the rolling procedure the large mass of the roll stand 1 is reciprocated at a high frequency. In the illustrated embodiment the roll stand is of a mass of about 10 tonnes while the direct drive acting on the flywheel, with a torque motor, produces 280 revolutions per minute. In particular the large mass of the roll stand 1 has to be completely braked at the reversal points of its translatory movement and then accelerated again in the opposite direction. The forces occurring in that case are carried exclusively by the electric motor 9 and passed from that by way of the mounting points thereof into the building enclosing the cold pilger rolling installation or a part thereof, in the illustrated embodiment the base plate of the cold pilger rolling installations. If, as proposed in accordance with the invention, a plurality of cold pilger rolling installations which are to be operated simultaneously are arranged in a building or a part of a building, the moments or forces which are generated by the roll stands in the oscillating movements thereof and which are then passed to the building by way of the drive train are added. They can become so great that the building suffers damage.

To avoid this, the arrangement according to the invention with a plurality of cold pilger rolling installations provides that the drive motors of the roll stands are coupled together by way of an electronic shaft.

FIG. 2 shows by way of example an arrangement comprising two cold pilger rolling installations 20, 21. They are arranged on a common foundation 22. Each of the cold pilger rolling installations 20, 21 is of a structure as is diagrammatically shown in FIG. 1. The drive of each roll stand 1 comprises a connecting rod 6 connected at an end 17 to the roll stand 1, a crank drive 10 connected to the other end 16 of the connecting rod 6 and having a compensating weight 12, and an electric motor connected directly to the shaft of the crank drive.

The two electric motors 9 diagrammatically shown in FIG. 2 for driving the crank drives 10 and therewith the roll stands 1 are coupled together by way of an electronic shaft 23.

FIG. 3 shows a diagrammatic view of a first embodiment of the 'electronic shaft' 23 of FIG. 2. An essential element of the electronic shaft 23 is an electric control 50 having two control outputs 51, 52, wherein the first control output 51 is connected to the electric motor 9 of the first cold pilger rolling installation 20 and the second control output 52 is connected to the electric motor 9 of the second cold pilger rolling installation 21.

The control 50 is so adapted that in operation of the installation it operates both electric motors 9 of the cold pilger rolling installations 20, 21 at the same angular frequency so that the roll stands perform an oscillating translatory movement also at the same frequency. To keep the application of vibrations to the common foundation 22 of the two rolling installations 20, 21 as low as possible the control 50 operates the two motors 9 in such a way that the roll stands have a phase displacement of 90°. That is to say while the roll stand of the first rolling installation 20 is just reaching a reversal point in its translatory movement the roll stand of the second cold pilger rolling installation 21 is just between the two reversal points of its translatory movement, that is to say it is moving at maximum speed.

In the illustrated embodiment the two rolling installations 20, 21 operate in a master-slave mode, wherein the first rolling installation 20 represents the master and the second rolling installation 21 represents the slave. In that case the electric motor 9 for driving the roll stand of the first rolling installation 20 is operated at a constant frequency and phase position while the phase position of the electric motor 9 of the second rolling installation 21 is so regulated that the phase difference between the oscillating movements of the roll stands of the two rolling installations 20, 21 is always precisely 90°.

To be able to compensate for irregularities in the movement of the two rolling installations 20, 21, that is to say to guarantee a constant phase displacement between the two oscillating movements of the two roll stands of the rolling installations 20, 21 over a long period of operation the control 50 is provided with two signal inputs 53, 54. Those signal inputs 53, 54 serve to detect the actual value of the phase positions of the oscillating movements of the roll stands of each rolling installation 20, 21. Thus the signal input 53 is connected to the motor 9 of the first rolling installation and the second signal input 54 is connected to the motor 9 of the second rolling installation. The instantaneous torque which the motor 9 applies for driving the roll stand of the rolling installation 20, 21 serves as a measuring signal. That is a direct measurement in respect of the instantaneous phase position of the oscillating translatory movement of the roll stand. If for example the roll stands are braked before and at their reversal points then the forces linked thereto have to be applied by the torque of the motor 9. Therefore the instantaneous torque of each electric motor 9 of the two rolling installations 20, 21, if plotted in relation to time, follows a sinusoidal configuration with maximum torques at the same time as the reversal in the direction of movement of the roll stands. It will be noted however that the torque in the idle mode (that is to say without tube shell) of the electric motors 9 is modulated with doubled the frequency as the oscillation of the roll stands themselves. By virtue of the doubling of the oscillation frequency of the torque in relation to time compared to the oscillation frequency of the roll stands a phase displacement of 90° for the oscillation movements of the roll stands corresponds to a phase displacement of 180° for the torques.

The phase displacement of the oscillating movements of the roll stands of the two rolling installations 20, 21 can be calculated from the two measuring signals which describe the variation in respect of time of the torque of each of the two electric motors 9 of the two rolling installations 20, 21. If that instantaneous actual value of the phase displacement is not equal to a predetermined reference value, in the present case 90°, the control 50 controls the electric motor 9 of the slave installation 21 in such a way that the reference value of 90° is regained. For that purpose the rotational frequency of the motor 9 of the slave installation 21 is briefly varied.

An alternative embodiment of the electronic shaft 23 of FIG. 2 is shown in FIG. 4. Once again the central element of the electronic shaft 23 is a control 50. As previously it is connected by way of two control outputs 51, 52 to the electric motors 9 of the roll stand drives of the rolling installations 20, 21. It will be noted however that in contrast to the electronic shaft in FIG. 3 the control 50 in the FIG. 4 embodiment has only one additional signal input 55 for a measuring signal. That input signal 55 is connected to a vibration sensor 56. That vibration sensor 56 is fixed to the foundation 22 of the two rolling installations 20, 21 and detects all vibrations which are transmitted from the two rolling installations 20, 21 to the foundation 22 and thus possibly also to other parts of the workshop enclosing the rolling installations 20, 21.

In this embodiment the control 50 is of such a configuration that it controls the phase displacement between the oscillating movements of the two roll stands of the two rolling installations 20, 21 in such a way that the vibrations detected by the sensor 56 and transmitted into the foundation 22 are minimised. For that purpose with the same rotational frequency in respect of the motors 9 of the two rolling installations 20, 21, the phase displacement thereof is varied until the vibrations in the foundation are minimal. The embodiment of FIG. 4 also provides that in an optional configuration the control 50 can have the signal inputs 51, 52 connected to the electric motors 9 of the rolling installations 20, 21 so that detection of the actual value of the phase displacement between the two oscillating movements of the roll stands of the two rolling installations is additionally possible.

For the purposes of the original disclosure it is pointed out that all features as can be seen by a man skilled in the art from the present description, the drawings and the claims, even if they have been described in specific terms only in connection with certain other features, can be combined both individually and also in any combinations with others of the features or groups of features disclosed herein insofar as that has not been expressly excluded or technical aspects make such combinations impossible or meaningless. A comprehensive explicit representation of all conceivable combinations of features is dispensed with here only for the sake of brevity and readability of the description.

While the invention has been illustrated and described in detail in the drawings and the preceding description that illustration and description is only by way of example and is not deemed to be a limitation on the scope of protection as defined by the claims. The invention is not limited to the disclosed embodiments.

Modifications in the disclosed embodiments are apparent to the man skilled in the art from the drawings, the description and the accompanying claims. In the claims the word 'have' does not exclude other elements or steps and the indefinite article 'a' does not exclude a plurality. The mere fact that certain features are claimed in different claims does not exclude the combination thereof. References in the claims are not deemed to be a limitation on the scope of protection.

LIST OF REFERENCES

1 roll stand
2 roll
3 roll
4 rolling mandrel
5 feed clamping saddle
6 connecting rod
7 spacing
8 shaft
9 electric motor
10 flywheel, crank drive
11 tube shell
12 compensating weight
16 first connecting rod end
17 second connecting rod end
18 axis of rotation
20 cold pilger rolling installation, master
21 cold pilger rolling installation, slave
22 foundation
23 electronic shaft
50 control
51 control output
52 control output
53 control output
54 control output
55 signal input
56 vibration sensor

The invention claimed is:

1. Apparatus having a plurality of cold rolling installations in a production unit, wherein each cold rolling installation includes a roll stand movable along a linear path and at least one roll which is fixed rotatably to the roll stand, a drive connected to the roll stand of each cold rolling installation and having an electric motor so adapted that the roll stand is drivable in an oscillating movement along the linear path, and a feed clamping saddle for feeding a blank, wherein each cold rolling installation works an individual blank and wherein the plurality of cold rolling installations work in parallel; and an electric control having at least two control outputs, wherein each control output is connected to the electric motor of the drive connected to the roll stand of each cold rolling installation, wherein, in operation of the apparatus, the electric control controls the electric motors to drive at least two of the roll stands with a phase displacement between the oscillating movements of the at least two roll stands such that superposition of individual mass forces arising from roll stands in the plurality of cold rolling installations of the apparatus are minimized, wherein the electric control has a first signal input for a first measuring signal and a second signal input for a second measuring signal, wherein, in operation of the apparatus, the electric control adjusts the phase displacement between the oscillating movement of a first of the at least two roll stands and the oscillating movement of a second of the at least two roll stands in dependence on the first measuring signal and the second measuring signal, wherein the first measuring signal is a measurement of an instantaneous phase position of the oscillating movement of the first of the at least two roll stands and the second measuring signal is a measurement of an instantaneous phase position of the oscillating movement of the second of the at least two roll stands, and wherein, in operation of the apparatus, the electric control determines from the first measuring signal and the second measuring signal an actual value of the phase displacement between the first of the at least two roll stands and the second of the at least two roll stands, compares the actual value of the phase displacement to a predetermined reference value of the phase displacement, and controls a first electric motor and a second electric motor so that a deviation between the actual value of the phase displacement and the predetermined reference value of the phase displacement does not exceed a predetermined threshold.

2. Apparatus as set forth in claim 1 wherein the first signal input is connected to a first electric motor and in operation of the apparatus the first measuring signal is a measurement of the instantaneous torque of the first electric motor, and wherein the second signal input is connected to a second electric motor and in operation of the apparatus the second measuring signal is a measurement of the instantaneous torque of the second electric motor.

3. Apparatus as set forth in claim 1 wherein the first signal input is connected to a first sensor for detecting the instantaneous phase position of the first of the at least two roll stands and the second signal input is connected to a second sensor for detecting the instantaneous phase position of the second of the at least two roll stands.

4. Apparatus as set forth in claim 3 wherein at least one of the first and second sensors is a torque sensor which detects the torque of the electric motor of one of the at least two roll stands.

5. Apparatus as set forth in claim 3 wherein at least one of the first and second sensors is an optical sensor.

6. Apparatus as set forth in claim 3 wherein at least one of the first and second sensors is a vibration sensor fixed to one of the plurality of cold rolling installations.

7. Apparatus as set forth in claim 1 wherein the electric control has a signal input for a measuring signal, wherein the signal input is connected to a vibration sensor for detecting vibrations transmitted by the plurality of cold rolling installations to a building enclosing at least a part of the plurality of cold rolling installations, and wherein the electric control is so adapted that in operation of the apparatus the electric control controls the electric motors such that the vibrations transmitted to the building are minimal.

8. A method of controlling an apparatus having a plurality of cold rolling installations in a production unit, wherein each of the plurality of cold rolling installations includes a roll stand movable along a linear path and at least one roll which is fixed rotatably to the roll stand, a drive connected to the roll stand and having an electric motor so adapted that the roll stand is drivable in an oscillating movement along the linear path, and a feed clamping saddle for feeding a blank, wherein each cold rolling installation works an individual blank and wherein the plurality of cold rolling installations work in parallel, the method comprising the steps of:

controlling the electric motor of a first drive of a first roll stand; and controlling the electric motor of a second drive of a second roll stand, wherein, in operation of the apparatus, the oscillating movement of the first roll stand and the oscillating movement of the second roll stand have a phase displacement adjustable such that superposition of individual mass forces arising from roll stands in the plurality of cold rolling installations of the apparatus are minimized.

9. A method as set forth in claim 8 wherein the method further comprises the steps of:

detecting a first measuring signal;

detecting a second measuring signal; and adjusting the phase displacement of the oscillating movements of the first and second roll stands in dependence on the first and second measuring signals.

10. A method as set forth in claim 9 wherein the first measuring signal is a measurement of the instantaneous phase position of the oscillating movement of the first roll stand and the second measuring signal is a measurement of the instantaneous phase position of the oscillating movement of the second roll stand and further comprising the steps of:

determining an actual value of the phase displacement between the oscillating movements of the first and second roll stands from the first measuring signal and the second measuring signal;

comparing the actual value of the phase displacement to a predetermined reference value of the phase displacement; and controlling the electric motor of the first drive of the first roll stand and the electric motor of the second drive of the second roll stand so that a deviation between the actual value of the phase displacement and the predetermined reference value of the phase displacement does not exceed a predetermined threshold.

11. A method as set forth in claim 10 wherein the first measuring signal is a measurement of the instantaneous torque of the electric motor of the first drive of the first roll stand and the second measuring signal is a measurement of the instantaneous torque of the electric motor of the second drive of the second roll stand.

12. A method as set forth in claim 8 wherein the method further comprises the steps of:

detecting a measuring signal which is a measurement of the vibrations transmitted from the plurality of cold rolling installations to a building enclosing at least a part of the plurality of cold rolling installations;

controlling the electric motor of the first drive of the first roll stand and the electric motor of the second drive of the second roll stand; and varying a phase displacement of the plurality of cold rolling installations such that, after the varying of the phase displacement, the vibrations transmitted to the building are minimal and a rotational frequency of the roll stands of the plurality of cold rolling installations is equal.

13. A method as set forth in claim 8 wherein the electric control is so adapted that in operation of the apparatus the electric control determines from the first measuring signal and the second measuring signal an actual value of the phase displacement between the first of the at least two roll stands and the second of the at least two roll stands, compares the actual value of the phase displacement to a predetermined reference value of the phase displacement, and controls the first electric motor and the second electric motor so that a deviation between the actual value of the phase displacement and the predetermined reference value of the phase displacement does not exceed a predetermined threshold.

14. A method as set forth in claim 8, wherein the first signal input is connected to a first sensor for detecting the instantaneous phase position of the first of the at least two roll stands and the second signal input is connected to a second sensor for detecting the instantaneous phase position of the second of the at least two roll stands.

15. A method as set forth in claim 14 wherein at least one of the sensors is an optical sensor.

16. A method as set forth in claim 15 wherein at least one of the first and second sensors is a vibration sensor fixed to one of the plurality of cold rolling installations.

17. Apparatus having a plurality of cold rolling installations in a production unit, wherein each cold rolling installation includes a roll stand movable along a linear path and at least one roll which is fixed rotatably to the roll stand, a drive connected to the roll stand of each cold rolling installation and having an electric motor so adapted that the roll stand is drivable in an oscillating movement along the linear path, and a feed clamping saddle for feeding a blank, wherein each cold rolling installation works an individual blank and wherein the plurality of cold rolling installations work in parallel; and an electric control having at least two control outputs, wherein each control output is connected to the electric motor of the drive connected to the roll stand of each cold rolling installation, wherein, in operation of the apparatus, the electric control controls the electric motors to drive at least two of the roll stands with a phase displacement between the oscillating movements of the at least two roll stands such that superposition of individual mass forces arising from roll stands in the plurality of cold rolling installations of the apparatus are minimized, wherein the electric control has a first signal input for a first measuring signal and a second signal input for a second measuring signal, wherein, in operation of the apparatus, the electric control adjusts the phase displacement between the oscillating movement of a first of the at least two roll stands and the oscillating movement of a second of the at least two roll stands in dependence on the first measuring signal and the second measuring signal, wherein the first signal input is connected to a first electric motor and in operation of the apparatus the first measuring signal is a measurement of the instantaneous torque of the first electric motor, and wherein the second signal input is connected to a second electric motor and in operation of the apparatus the second measuring signal is a measurement of the instantaneous torque of the second electric motor.

18. Apparatus according to claim 17, wherein, in operation of the apparatus, the control controls the electric motors such that the oscillating movements of the first roll stand and the second roll stand have a phase displacement relative to each other in a range from 75° to 105°.

19. Apparatus according to claim 17, wherein, in operation of the apparatus, the control controls the electric motors such that the oscillating movements of the first roll stand and the second roll stand have a phase displacement relative to each other in a range from 165° to 195°.

20. Apparatus according to claim 1, wherein, in operation of the apparatus, the control controls the electric motors such that the oscillating movements of the first roll stand and the second roll stand have a phase displacement relative to each other in a range from 75° to 105°.

21. Apparatus according to claim 1, wherein, in operation of the apparatus, the control controls the electric motors such that the oscillating movements of the first roll stand and the second roll stand have a phase displacement relative to each other in a range from 165° to 195°.

* * * * *